United States Patent [19]

Hinchcliffe et al.

[11] 4,078,648

[45] Mar. 14, 1978

[54] RESERVOIRS FOR CIGARETTES

[75] Inventors: Dennis Hinchcliffe; Frank Heybourn; Eric Alfred Luddington, all of Deptford, England

[73] Assignee: Molins Limited, England

[21] Appl. No.: 622,709

[22] Filed: Oct. 15, 1975

[30] Foreign Application Priority Data

Oct. 18, 1974 United Kingdom ..... 45316/74

[51] Int. Cl.[2] ..... B65G 43/08

[52] U.S. Cl. ..... 198/347; 53/148; 53/236; 198/603; 198/605

[58] Field of Search ..... 198/37, 76, 20 C, 35, 198/31 R, 75, 78, 102, 165, 69, 603, 347, 604, 605; 214/16 R, 16 B; 53/148, 236; 221/67, 225, 251, 237; 194/4 R

[56] References Cited

U.S. PATENT DOCUMENTS 3,297,138 1/1967 McCombie ..... 53/148 X 3,620,349 11/1971 McCombie ..... 198/35 X 3,921,790 11/1975 Hincheliffe et al. ..... 198/37

FOREIGN PATENT DOCUMENTS 1,309,071 3/1973 United Kingdom.

*Primary Examiner*—Robert W. Saifer

*Assistant Examiner*—Douglas D. Watts

*Attorney, Agent, or Firm*—Craig & Antonelli

[57] ABSTRACT

A conveyor system for conveying cigarettes or similar rod-like articles includes machinery for delivering cigarettes into a junction, and a reservoir including a reversible conveyor for delivering cigarettes to or from the junction to accommodate differences between the rates of supply and demand at the junction, characterized in that the reservoir is formed by a plurality of conveyors defining a zig-zag path extending substantially in a constant plane normal to the axis of the cigarettes and comprising at least two substantially horizontal runs with one or more connecting portions through which cigarettes pass from one run to another.

13 Claims, 9 Drawing Figures

52
48
52'''
52''''
54
55
46
44
42
40
38
31
36
34
33
52'
50
52''
2
12
6
4
8

80
94
88
78
94
86
72
94
12
2
6
4
68
8
94
98
56
66
58
56A
56B
90
92
62
60
94
82
76
74
94
70
94
84
96
96

RESERVOIRS FOR CIGARETTES

This invention is concerned with conveyor systems for conveying cigarettes and other similar rod-like articles, for example cigarette filter rods. For convenience the invention will be described with reference to cigarettes, but it should be understood that systems, methods and devices according to this invention can be used with other rod-like articles, especially cigarette filter rods.

British patent specifications Nos. 1,299,174 and 1,299,175 describe conveyor systems for cigarettes including a reservoir arranged to receive a continuous stack of cigarettes, the length of the stack when the reservoir is full being considerably greater than the thickness. This is achieved, in the arrangements illustrated in the above patent specifications, by arranging in each example that the stack in the reservoir is carried by a conveyor which extends along a helical path.

According to one aspect of the present invention a conveyor system for cigarettes includes a reservoir formed by a number of conveyors defining a zig-zag path extending substantially in a constant plane normal to the axis of the cigarettes.

Compared with the helical reservoir mentioned above, the reservoir according to the present invention makes possible a more compact construction since the reservoir has a width which is not very much greater than the length of the cigarettes. Furthermore, the cigarettes remain in a substantially constant orientation and are not required to tilt relative to one another as they pass round the bend from one run of the zig-zag to another run; this is especially useful for relatively long cigarettes or for filter rods which may have a length of 120 mm or more.

The plane of the zig-zag path of the reservoir is preferably vertical (i.e. with the cigarettes lying horizontal); the successive runs of the zig-zag, starting from the inlet to the reservoir, are preferably horizontal and at increasingly higher levels, though they may alternatively be at increasingly lower levels. Alternatively, the plane of the zig-zag path could be horizontal, with the cigarettes lying vertically.

The term "zig-zag" refers particularly to an arrangement in which there are three or more runs (e.g. one above the other) but it is intended to include also an arrangement in which there are only two runs.

According to another aspect this invention, a conveyor system for cigarettes or other similar rod-like articles includes a conveyor for delivering cigarettes into a junction from which there is an outlet channel (e.g. leading to a cigarette packing machine), and the system includes a reservoir comprising at least two substantially horizontal conveyors which lie one above the other and communicate with the junction, the reservoir conveyors being reversible so that they can receive cigarettes from the junction or deliver cigarettes into the junction according to the state of supply and demand at the junction.

The two reservoir conveyors preferably move in unison; that is to say, in the same direction and at the same speed. Alternatively, the arrangement may be such that one reservoir conveyor at a time is driven; for example, one reservoir conveyor draws cigarettes from the junction zone until it is full, whereupon the other reservoir conveyor begins to operate (starting empty) to draw in cigarettes.

The two reservoir conveyors may respectively form parts of two conveyor mechanisms extending along a zig-zag path as described above. Preferably, one of the conveyors is or includes a part which is laterally flexible and extends along a path which bends out of the vertical plane of the other conveyor and then extends in a zig-zag direction side-by-side with the zig-zag path of the other conveyor; by this means, the reservoir capacity can be doubled without significantly increasing the vertical extent of the reservoir. The reservoir capacity may even be trebled if three conveyors are used, two being arranged to move along paths which bend in opposite directions from the vertical plane of the third conveyor and then extend in a zig-zag direction on opposite sides of the zig-zag path of the third conveyor.

Examples of conveyor systems according to this invention are shown in the accompanying drawings. In these drawings.

Figure 1:
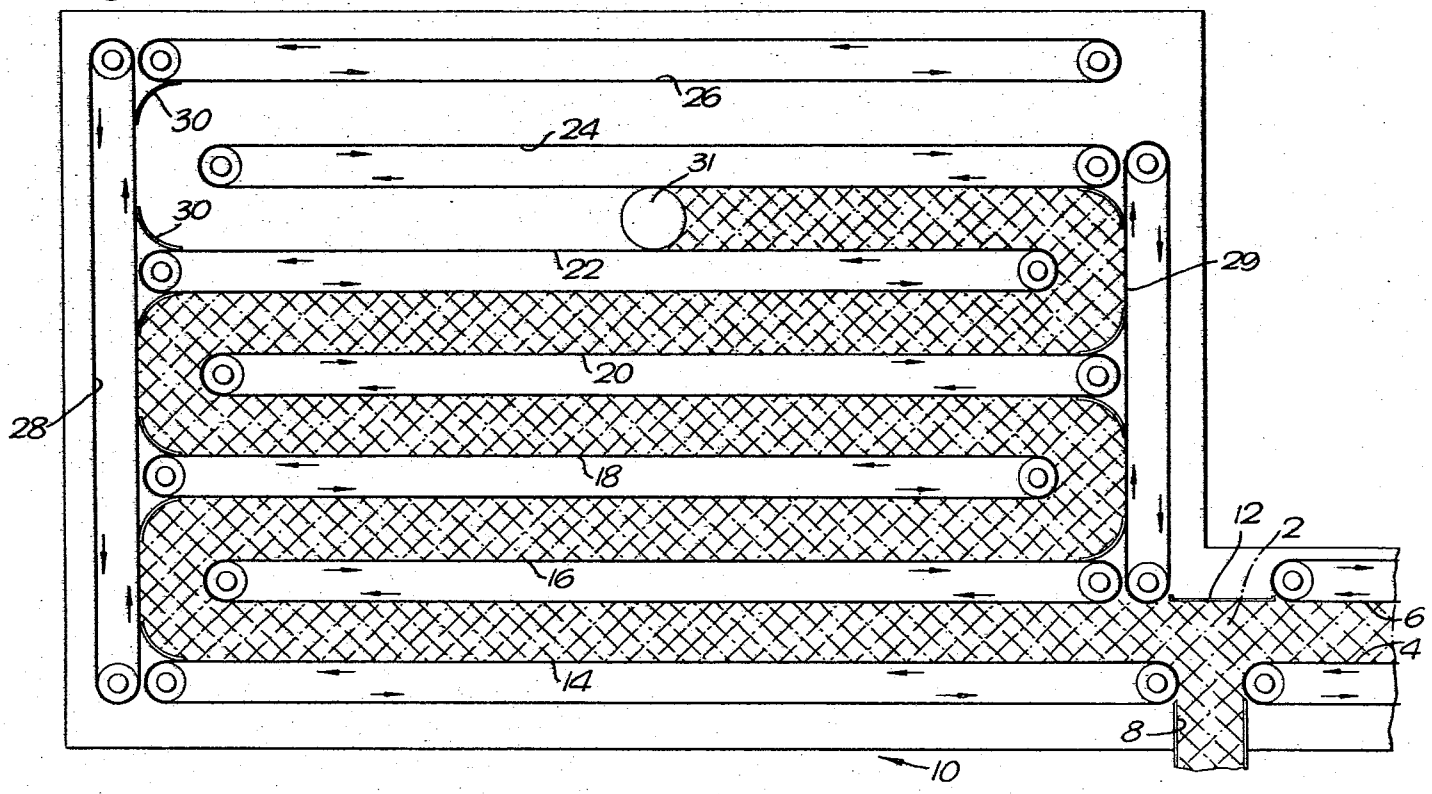
FIG. 1 is a diagrammatic side view of a system with one form of reservoir.

The system shown in FIG. 1 has a junction 2 into which cigarettes are delivered in stack formation between conveyor bands 4 and 6, the cigarettes being received for example from a cigarette making machine as described in the above-mentioned patent specifications. Below the junction 2 there is a chute 8 from which a stack of cigarettes normally passes downwards to a cigarette packing machine. However, when the packing machine stops, the cigarettes fed into the junction 2 are fed into a reservoir 10. The conveyor bands of the reservoir 10 are shown moving in the direction necessary to draw cigarettes into the reservoir from the junction; however, it should be understood that the direction of motion of all the bands in the reservoir is reversed when the reservoir is required to deliver cigarettes into the junction 2, for example when the cigarette making machine stops while the packing machine continues to operate. A sensor 12 above the junction 2 determines the direction of motion and preferably also the speed of the reservoir bands; this sensor 12 is shown diagrammatically and may for example be in accordance with any one of the sensors described in German OS No. 2,320,843 to which reference in its entirety is directed.

The conveyor bands of the reservoir are all driven at the same speed and define an elongated reservoir space extending upwards along a zig-zag path in a vertical plane as shown by the cross-hatched area. The horizontal runs of the zig-zag path are defined by bands 14,16, 18, 20, 22 24 and 26. Furthermore there are two vertical bands 28 and 29 at opposite ends of the reservoir which assist in moving the stack of cigarettes between successive horizontal runs. In the corners between the horizontal and vertical bands there are concave fillet plates 30.

Figure 2:
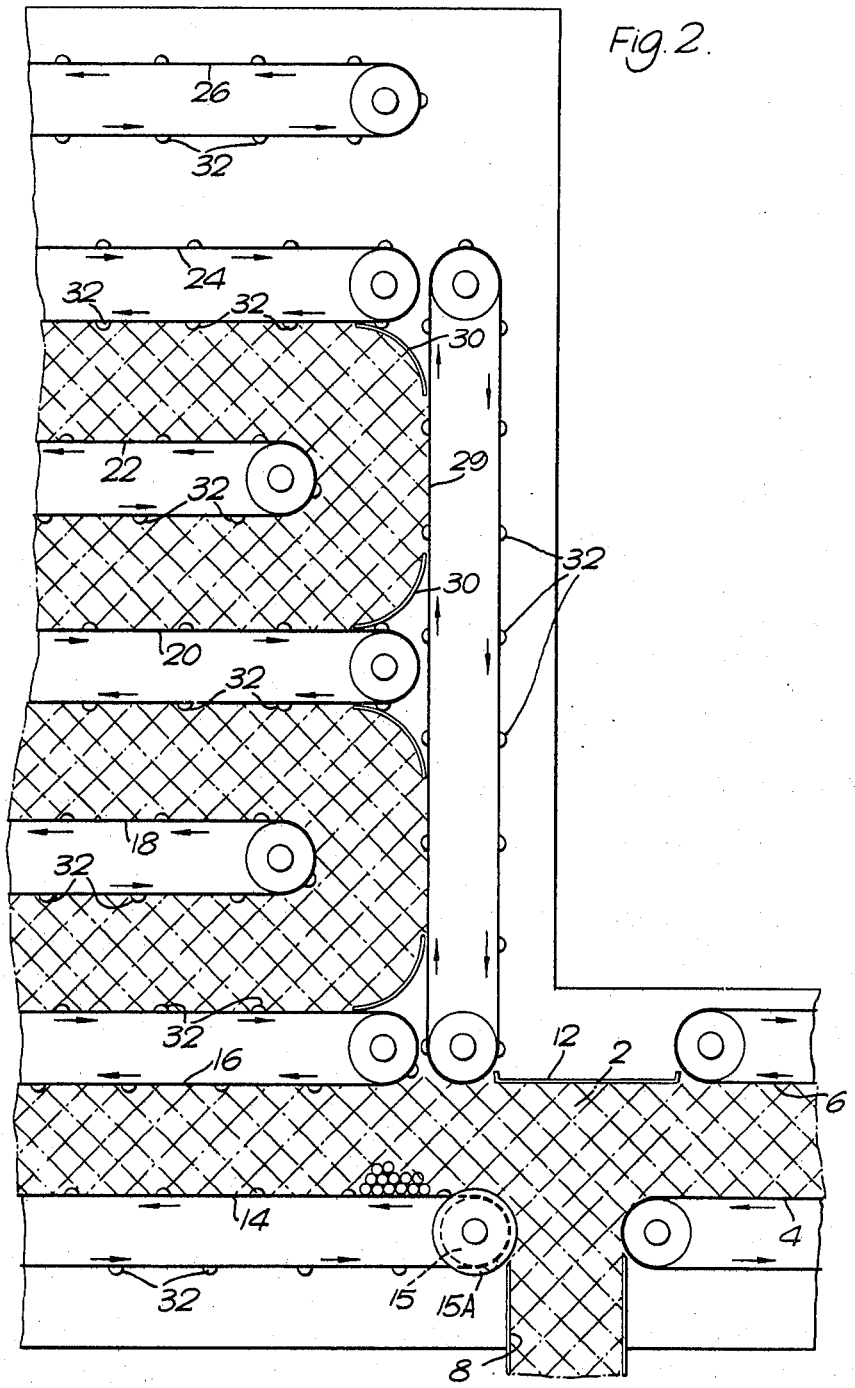
FIG. 2 is an enlarged view of part of the system shown in FIG. 1, with some additional details.

FIG. 2 shows, on a larger scale, the right-hand half of a reservoir generally similar to that shown in FIG. 1, as indicated by the use of similar reference numerals. In the reservoir shown in FIG. 2, the bands are formed with transverse ribs 32 to assist in driving forward the stack of cigarettes. Each rib may have a cross-section equal to half that of a cigarette. Also, in the modification shown in FIG. 2, the pulley 15 around which the band 14 passes adjacent to the junction 2 has flanges 15A at opposite ends (on opposite sides of the band 14) to guide the cigarettes when in the region of the pulley, in accordance with the invention described in German OS No. 2,353,806 to which reference in its entirety is directed. The fillet plates 30 preferably extend close to the adjacent bands, as shown in FIG. 2 and have recesses at their edges adjacent to the bands through which the ribs 32 can pass.

As shown in FIG. 1, the end of the stack of cigarettes in the reservoir may be defined by a body 31 of compressible material, for example a sponge plastic material, which is gripped between opposing bands. The cross-section may be circular, as shown; alternatively it may, for example, be rectangular.

Figure 3:
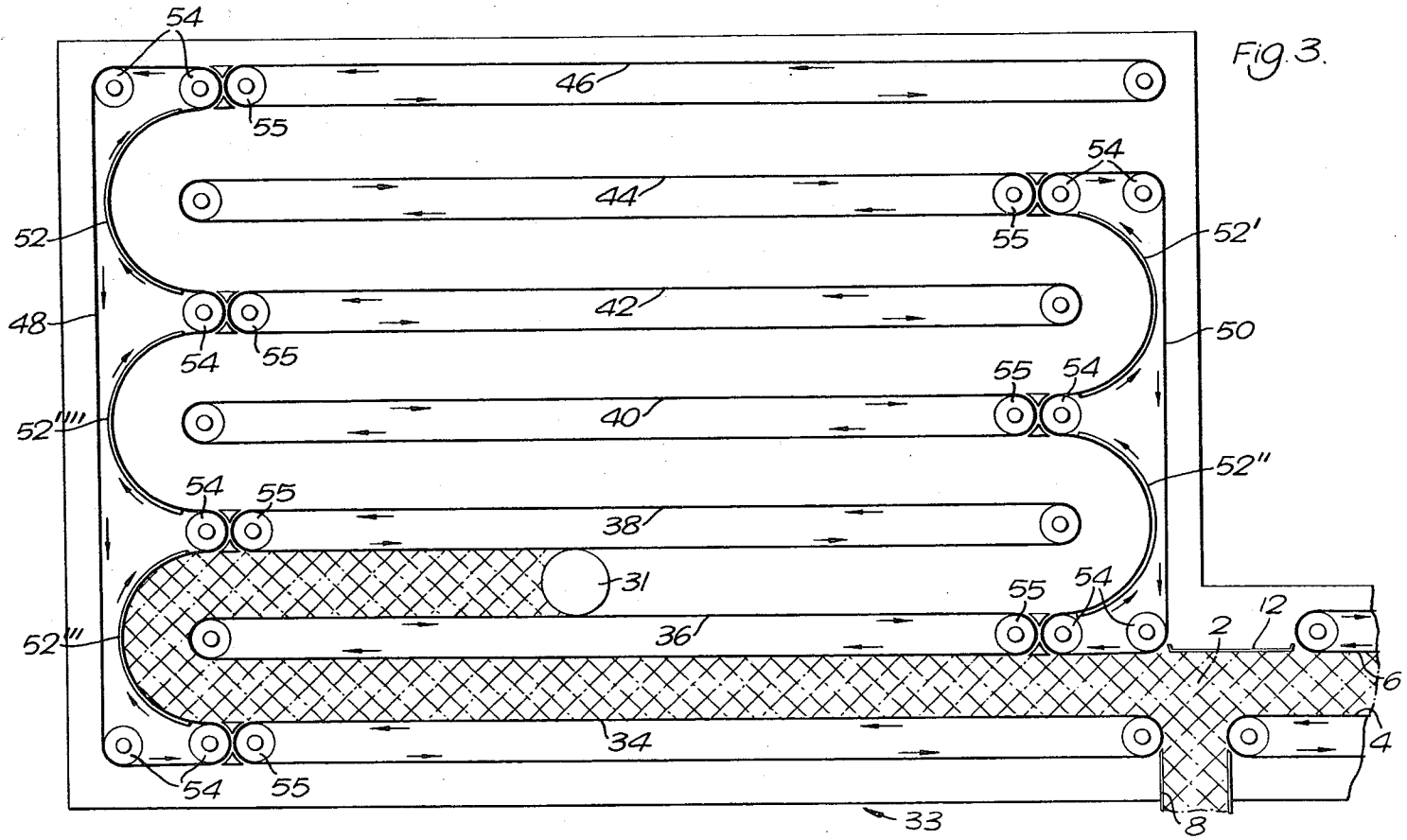
FIGS. 3 and 4 are diagrammatic side views of different systems.

FIG. 3 shows a system which is similar in some respects to that shown in FIG. 1, as indicated by the use of similar reference numerals where appropriate. This system includes a reservoir 33 comprising a number of horizontal bands 34, 36, 38, 40, 42, 44 and 46 which define the horizontal runs of the zig-zag path of the reservoir. The connecting parts of the runs are defined, however, partly by two bands 48 and 50 which, in their operative regions, move along curved paths defined by curved backing members 52 52′, 52″, 52‴ and 52⁗. The bands 48 and 50 also pass around various pulleys 54 as shown. The end of the stack of cigarettes in the reservoir is again defined by a body 31, as in FIG. 1.

The bands 34, 36 etc. are shown passing around pulleys 55 adjacent to pulleys 54. As an alternative the pulleys 55 may be omitted and the bands 34, 36 etc. may pass around the adjacent pulleys 54, with provision for appropriate intercalation of the bands; for example, each of the bands 48 and 50 may comprise a pair of spaced parallel bands between which the bands 34, 36 etc. pass.

The bands 48 and 50 may be driven at the same speed as the bands 34, 36 etc, or at a somewhat higher speed bearing, for example, a fixed ratio to the speed of the bands 34, 36 etc.

It is not essential for the bands forming successive runs of the zig-zag to be driven at the same speed. Each run after the first adjacent to the junction 2 may move at a speed which is controlled by a sensor which detects the pressure of the cigarettes in the connecting zone (i.e. between adjacent runs) at the upstream end of that run, the stream direction being that shown by the arrows in FIGS. 1 and 3.

Instead of all the connecting portions (i.e. between adjacent runs) at each end of the reservoir being defined by a single band 48 or 50, each connecting portion may be defined by a separate band arranged to move along the associated curved backing members 52. In other words, in the reservoir shown in FIG. 3, there may be five separate bands each arranged to move along one of the curved backing members 52 52′, 52″ and 52‴ and 52⁗; for this purpose each pulley 54 would, where necessary, be replaced by two adjacent pulleys of smaller diameter for the respective bands.

Each band may be lightly tensioned so that it grips the cigarettes passing through the associated connecting portion; it will be understood that, in this case, each band may pull away slightly from the associated backing members 52 52′, 52″, 52‴ and 52⁗ as a result of the tension. Movement of the band or of the tensioning roller or other tensioning means may be monitored to provide a signal indicating the quantity of cigarettes in the associated connecting portion of the reservoir. This signal may be used to vary the speed of the band and/or of the horizontal conveyor towards which the cigarettes are being fed, to ensure that there are no cavities in the cigarette stack.

Figure 4:
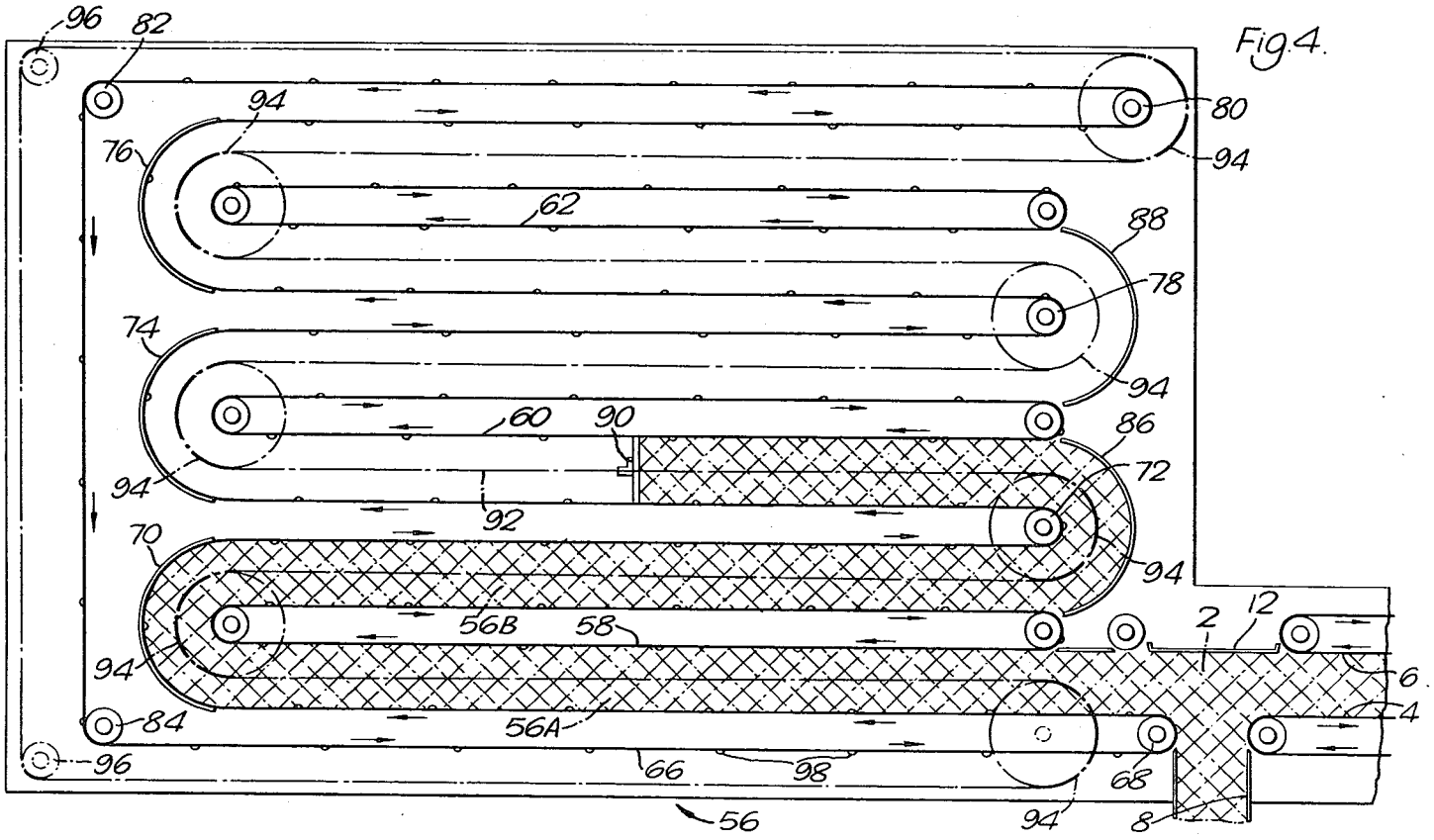

FIG. 4 shows a system which is also similar to the arrangement shown in FIG. 1, as indicated by the use of the same reference numerals. In this example there is a reservoir 56 including horizontal bands 58, 60 and 62 which partly define the horizontal runs of the zig-zag path. In addition there is a band 66 which extends from a pulley 68 adjacent to the junction 2, partly defines the first horizontal run 56A of the zig-zag path in the reservoir, extends along a curved path backed by a backing member 70 to define a connecting portion of the zig-zag path leading to a second horizontal run 56B, extends horizontally along the top of the run 56B, round a pulley 72 and further onwards as shown, past backing members 74 and 76 and around a pulley 78, and returns by passing around pulleys 80, 82 and 84.

The outer boundary of the connecting portions of the zig-zag path at the right-hand end of FIG. 4 are defined by concave plates 86 and 88. However, there may in addition be a band like the band 50 shown in FIG. 3. Another possibility is that the bands 58, 60 and 62 could be replaced by a single continuous band similar to the band 66, which moves along the plates 86 and 88.

The end of the stack of cigarettes in the reservoir is defined by a plate 90. This is carried by two cables or chains 92 lying on opposite sides of the reservoir. Each cable or chain 92 passes around a number of pulleys 94 adjacent to the ends of the horizontal runs of the zig-zag path, and also around two smaller pulleys 96. The cables or chains 92 are driven at the same speed as the various bands, so that the plate 90 moves at the same speed as the stack of cigarettes in the reservoir. The plate 90 is clamped to the cables or chains 92 so as to remain at right angles to the cables or chains.

FIG. 4 shows ribs 98 on the various bands, though at larger intervals than may be used in practice.

It should be understood that the bands in the reservoir shown in FIG. 3 may also be formed with ribs, the spacing and dimensions being preferably as described with reference to FIG. 2. Pulleys of the same form as the pulley 15 shown in FIG. 2 may be used where desired, for example in place of the pulleys 54 shown in FIG. 3.

Apart from the use of the above-described zig-zag conveyor systems as a reservoir, the bands may be arranged to run always in the same direction so that cigarettes or other similar articles enter one end of the zig-zag and are discharged at the other end. Such an arrangement may be useful if, for example, cigarette filters are required to be delayed in their travel from a filter making machine to a filter handling machine. A possible system for that purpose may be as follows: filters enter the upper end of a downwardly extending zig-zag path at the outlet end of which there is a junction from which filters pass into a channel leading to a filter handling machine, and there is also an upwardly extending zig-zag reservoir (as described above) which automatically receives filters from the junction or delivers filters into the junction when necessary; in other words, the two zig-zag parts are arranged end to end.

Figure 5:
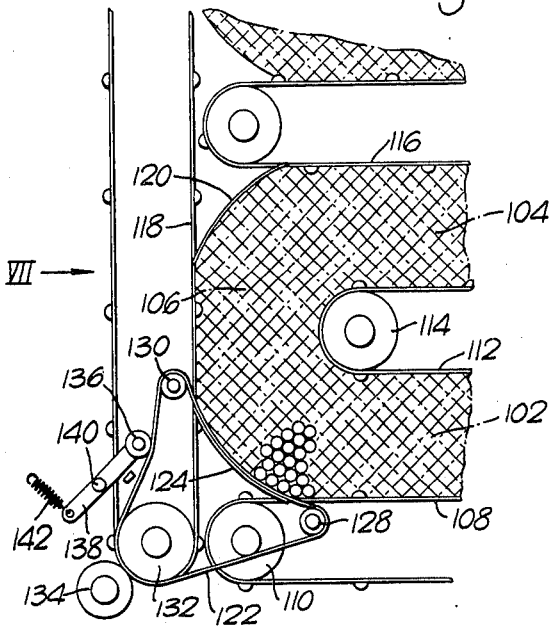
FIG. 5 shows a modification of part of the reservoir shown in FIG. 2.

Each of the connecting portions of the reservoir shown in FIG. 1 or FIG. 2 may be modified in the manner shown in FIG. 5. FIG. 5 shows the left-hand ends of the two lowest runs 102 and 104, these being connected by a connecting portion 106. The lower run 102 is defined partly by a ribbed band 108, which passes around a pulley 110, and partly by a ribbed band 112 which passes around a pulley 114. The band 112 also cooperates with a ribbed band 116 to define the upper run 104.

Figure 7:
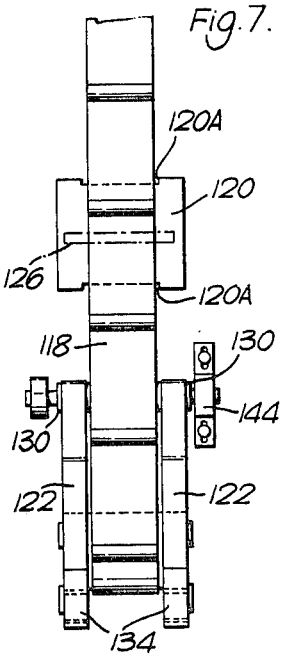
FIG. 7 is a view in the direction of the arrow VII in FIG. 5.

As in FIG. 2, there is a vertical ribbed band 118 which partly defines the connecting portion 106 of the zig-zag and also extends vertically upwards to assist in forming other connecting portions of the reservoir. The connecting portion 106 is completed by a curved plate 120 and by two parallel narrow bands 122 which lie on opposite sides of the bands 108 and 118 and are backed by curved backing members 124. The position of one cigarette 126 is shown in FIG. 7, from which it can be seen that the bands 122 engage the cigarettes at their ends, while the bands 108 and 118 (and also the band 116) engage middle regions of the cigarettes. As shown in FIG. 7, the plate 120 is wider than band 118 and band 116 and has recesses 120A through which the ribs on the bands can pass.

Each of the narrow bands 122 passes around pulleys 128, 130 and 132; the pulleys 132 are on opposite sides of, and are possibly integral with, a coaxial pulley of the same diameter around which the vertical band 118 passes. Each band 122 is driven by its pulley 132, being pressed against the pulley by a roller 134. Furthermore, the bands 122 are tensioned by a roller 136 on a lever 138 which is pivoted at 140 and is acted upon by a tension spring 142.

The narrow bands 122 help in moving the cigarettes through the connecting portion 106 in an upward direction; i.e. from the run 102 to the run 104. They are preferably driven (reversibly) at a greater speed than the bands 108 and 112, for example at twice the speed; the band 118 may be driven at the same speed as the bands 122.

In the case of filter-tipped cigarettes, the tobacco and filter ends may have a different firmness and possibly also different diameters. The following provision is included to allow adjustment for accommodating any such differences. One of the pulleys 130 (see FIG. 7) is mounted on a spindle carried by a vertically adjustable member 144. Therefore the effective operative length of the associated band 122 is adjustable. This allows adjustment to ensure that the cigarettes pass through the connecting portion 106 at a substantially constant orientation; that is to say, avoiding any tendency which might otherwise exist for some cigarettes to become inclined to the horizontal. As an alternative, both pulleys 130 may rotate about fixed axes, and the two bands 122 may be separately tensioned with provision for adjusting the tensioning of at least one of the bands 122.

Figure 6:
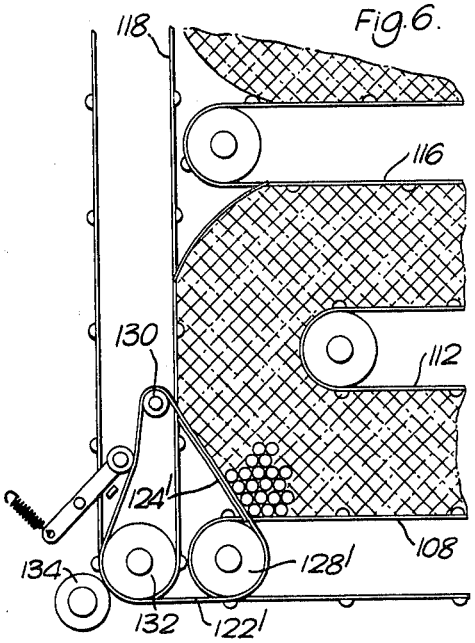
FIG. 6 shows a different modification of part of the reservoir shown in FIG. 2.

FIG. 6 shows a possible modification of the arrangement shown in FIG. 5; similarities between the two arrangements are shown by the use of similar reference numerals. Whereas the bands 122 in FIG. 5 have curved backing members 124 (curved approximately about the axis of the pulley 114,) the arrangement in FIG. 6 has bands 122' which are arranged to move along straight backing members 124'. Also, the pulleys 128 in FIG. 5, are replaced in FIG. 6 by pulleys 128' which are coaxial with, and of the same diameter as, the pulley 110, which lies between the two pulleys 128' for the respective bands 122'.

Figure 8:
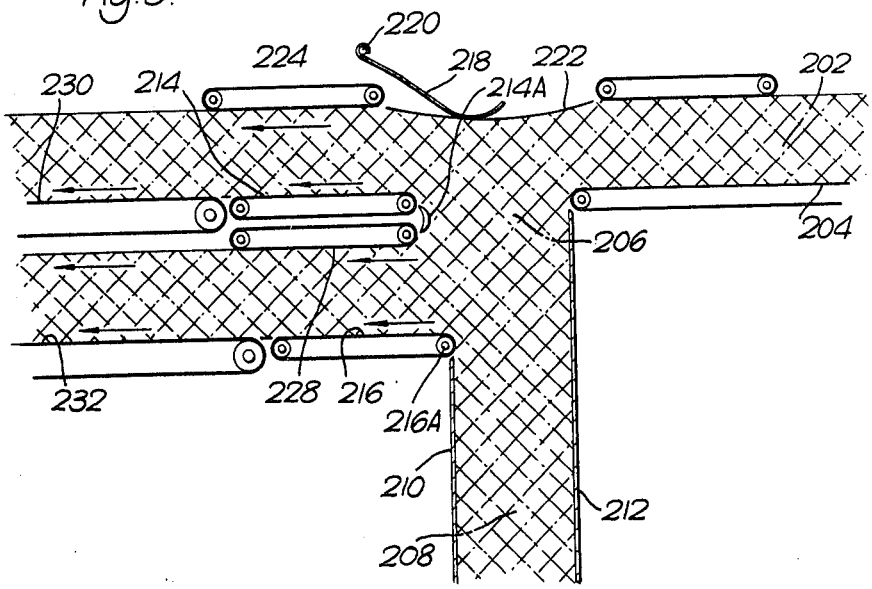
FIG. 8 is a diagrammatic side view of part of another different system.

FIG. 8 shows part of a system in which a stack of cigarettes 202 is fed by a conveyor 204 into a junction 206 from which a stack of cigarettes 208 can pass downwards through a chute formed by walls 210 and 212 leading into a cigarette packing machine.

Adjacent to the junction 206 there are two reversible reservoir conveyors 214 and 216, lying one above the other, each arranged to convey a stack of cigarettes into or out of the junction 206. The conveyors 214 and 216 are driven in the same direction and at the same speed under the control of a sensor 218 which is pivotally mounted at 220 and rests on a membrane 222 confining the cigarettes in the junction. Above the conveyors 214 and 216 there are parallel top conveyors 224 and 228 which move in unison with the conveyors 214 and 216 and serve to define the upper surfaces of the stacks of cigarettes on the conveyors 214 and 216.

The conveyors 214, 216, 224 and 228 are shown (by arrows) moving in the direction in which they draw cigarettes from the junction 206. The directions are all reversed when the reservoir is required to deliver cigarettes back into the junction 206.

FIG. 8 also shows conveyors 230 and 232 which form extensions of the conveyors 214 and 216. The conveyors 230 and 232 may simply extend along straight horizontal paths. Alternatively, each may form part of a conveyor system extending along or defining a zig-zag path extending upwards or downwards, as shown in FIGS. 1 to 7; for this purpose, one of the conveyors 230 or 232 is preferably laterally flexible so as to be capable of moving along a curved path (as illustrated in FIG. 9) so that the two zig-zag conveyor systems can be arranged side-by-side.

Figure 9:
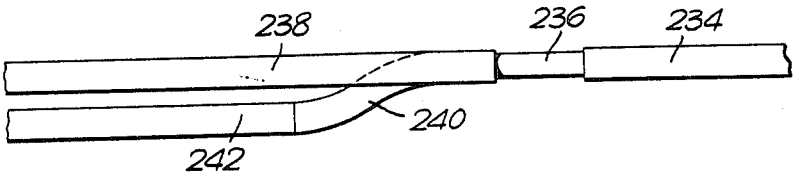
FIG. 9 is a diagrammatic plan view of a modified form of the system shown in FIG. 8.

FIG. 9 shows diagrammatically a conveyor 234 which delivers a stack of cigarettes to a junction zone below a membrane 236 above which there is a sensor (not shown) like the sensor 218 shown in FIG. 8. Two reservoir conveyors 238 and 240 are arranged to deliver cigarettes into or out of the junction when necessary. The conveyor 238 moves along a straight horizontal path and forms the initial horizontal run of a zig-zag conveyor system. The conveyor 240, which lies below the conveyor 238, is laterally flexible and it moves along a path which bends horizontally out of the vertical plane of the conveyor 238. A conveyor 242 forms an extension of the conveyor 240 and forms the initial horizontal run of a zig-zag conveyor system lying side-by-side with the other zig-zag system.

The laterally flexible conveyor 240 may be of the general construction described in British patent specification No. 1,309,071.

With regard to FIG. 8 it should be noted that the right-hand end of the top conveyor band 228 lies to the left of the right-hand end of the conveyor 216. The arrangement may, for example, be such that a line tangential to the pulley 216A of the conveyor 216 and tangential to a stationary curved bridge 214A is inclined to the vertical by approximately 30°. This helps to ensure that a full-height stack of cigarettes is carried away by the conveyor 216 when it moves to the left. Similarly, the right-hand end of the top conveyor 224 lies to the left of the right-hand end of the conveyor 214.

Instead of both reservoir conveyors moving in unison, they may be arranged to move one at a time in a predetermined sequence. In such an arrangement each main reservoir conveyor 230 and 232 preferably carries or drives an end wall which can pass over the associated short conveyor 214, 216 when the reservoir is being emptied, e.g. as shown in FIGS. 18 and 19 of British patent specification No. 1,299,174. The sequence of operation is then preferably as follows: starting with the reservoir empty, the upper section of the reservoir does not start to draw in cigarettes until the lower section has filled; however, once both sections contain cigarettes, when the reservoir is required to deliver cigarettes back into the junction, it is the upper section that operates first and the lower section does not begin to empty until the upper section is completely empty. This sequence is preferred in order to avoid the formation of cavities in the cigarette stack in the junction.

It should be noted that, in FIGS. 1 to 4, the stack of cigarettes received by the reservoir, has a thickness which is approximately equal to the thickness of the stack delivered downwards through the chute 8, and is approximately equal to the thickness of the stack of cigarettes delivered into the junction 2 by the conveyor 4; the thickness of the stack in the reservoir is preferably 75 to 125 mm., e.g. approximately 100 mm. Furthermore, the chute and the adjacent conveyors form a T junction whereby, when the flow of cigarettes through the chute stops, the stack of cigarettes delivered by the conveyor 4 passes straight through the junction and into the reservoir. These features minimise degradation of the cigarettes through minimising relative movement of the cigarette and pressure on the cigarettes.

In the example shown in FIG. 8, each of conveyors 230 and 232 of the reservoir carries a stack having a thickness substantially equal to that of the stack on the conveyor 204 and approximately equal to that of the stack delivered down the chute 210, 212.

We claim:

1. A conveyor system for conveying cigarettes or similar rod-like articles, including means for delivering cigarettes into a junction, outlet means for receiving cigarettes from the junction, and a reservoir spaced from said outlet means and including a reversible conveyor for delivering a stack of cigarettes to or from the junction to accommodate differences between the rates of supply and demand at the junction, characterised in that the reservoir is formed by a plurality of conveyors defining a zig-zag path extending substantially in a constant plane normal to the axis of the cigarettes, said conveyors forming at least two substantially horizontal conveyor runs, one above the other, and one or more connecting conveyor portions through which cigarettes are conveyed from one run to another, each said connecting portion comprising two opposed reversible conveyors arranged to engage opposite sides of the cigarette stream to move the stream upwards or downwards and being spaced apart by a distance substantially equal to the thickness of the stack of cigarettes adapted to be carried by said horizontal runs.

2. A conveyor system according to claim 1, including an end wall movable with the reservoir conveyors to define the end of the stack of cigarettes in the reservoir.

3. A conveyor system according to claim 1, including a second zig-zag reservoir section mounted side-by-side with the first-mentioned zig-zag reservoir and adapted to receive cigarettes from the junction via a laterally flexible conveyor extending along a path which starts in the plane of the first-mentioned zig-zag reservoir and bends out of that plane and into the plane of the second zig-zag reservoir section.

4. A conveyor system for conveying cigarettes or similar rod-like articles, including means for delivering cigarettes into a junction, means for receiving cigarettes from the junction, and a reservoir including a reversible conveyor for delivering cigarettes to or from the junction to accommodate differences between the rates of supply and demand at the junction, characterized in that the reservoir is formed by a plurality of conveyors defining a zig-zag path extending substantially in a constant plane normal to the axis of the cigarettes and comprising at least four substantially horizontal runs with one or more connecting portions through which cigarettes pass from one run to another, and in which at least two connecting portions, one above the other, are defined at least partly by a common conveyor.

5. A conveyor system according to claim 4 in which the common conveyor is formed with transversely extending ribs to engage the cigarettes and assist upward conveyance of the cigarettes.

6. A conveyor system according to claim 4 in which the common conveyor is arranged to move along a substantially straight path.

7. A conveyor system according to claim 6 in which the common conveyor and an adjacent horizontal conveyor of the reservoir have a width substantially less than the length of the cigarettes, and including at at least one connecting portion of the reservoir a pair of parallel conveyor bands lying on opposite sides of the common conveyor and on opposite sides of the adjacent horizontal conveyor of the reservoir to support the ends of the cigarettes, the operative parts of the parallel bands extending obliquely upwards across a corner between the common conveyor and the adjacent horizontal conveyor to assist in driving the cigarettes upwards through the associated connecting portion of the reservoir.

8. A conveyor system for cigarettes or similar rod-like articles, including a conveyor for delivering cigarettes into a junction from which there is an outlet channel, and a pair of reservoirs, each reservoir comprising a plurality of reversible substantially horizontal stack-holding conveyors defining a zig-zag path including at least two substantially horizontal conveyor runs which lie one above the other, each of which reservoirs communicate with the junction, and means for controlling said stack-holding conveyors in each reservoir so that the reservoirs individually receive separate stacks of cigarettes from the junction or return the said cigarettes into the junction according to the state of supply and demand at the junction, said two reservoirs lying side-by-side with at least one reservoir communicating with said junction by way of a laterally flexible conveyor section which bends out of the vertical plane of the other reservoir.

9. A conveyor system according to claim 8, including means for driving the two reservoir conveyors in unison.

10. A conveyor system according to claim 8, including means for driving the two reservoir conveyors one at at time.

11. A conveyor system according to claim 8 in which the ends of the reservoir conveyors adjacent to the junction are positioned relative to one another so that the end of the upper conveyor lies above a point on the lower reservoir conveyor inwardly spaced from the end of that conveyor.

12. A conveyor system for conveying cigarettes or similar rod-like articles, including means for delivering cigarettes into a junction, means for receiving cigarettes from the junction, and a reservoir including a reversible conveyor for delivering cigarettes to or from the junction to accommodate differences between the rates of supply and demand at the junction, characterised in that the reservoir is formed by a plurality of conveyors defining a zig-zag path extending substantially in a constant plane normal to the axis of the cigarettes and comprising at least four horizontal runs, one above the other, and means defining connecting portions through which the cigarettes pass from one run to another, said means including a vertically extending conveyor which partly defines at least two connecting portions.

13. A conveyor system according to claim 12 in which the vertically extending conveyor includes means for engaging the cigarettes for positively driving the cigarettes upwards.

* * * * *